US005943957A

United States Patent [19]

Mason

[11] Patent Number: 5,943,957

[45] Date of Patent: Aug. 31, 1999

[54] METHOD AND DEVICE FOR IN-MOLD PAD PRINTING

[75] Inventor: Christopher W. Mason, Elkhart, Ind.

[73] Assignee: Nibco Inc., Elkhart, Ind.

[21] Appl. No.: 09/041,481

[22] Filed: Mar. 12, 1998

[51] Int. Cl.[6] ..... B41F 17/00

[52] U.S. Cl. ..... 101/483; 101/170; 101/41

[58] Field of Search ..... 101/35, 41, 42, 101/43, 44, 150, 163, 167, 169, 170, 483

[56] References Cited

U.S. PATENT DOCUMENTS

| | | | |
|---|---|---|---|
| 3,580,772 | 5/1971 | Ochoa | 156/240 |
| 3,910,183 | 10/1975 | Noren et al. | 101/41 |
| 4,015,525 | 4/1977 | Shenoha | 101/333 |
| 4,060,031 | 11/1977 | Philipp | 101/163 |
| 4,289,817 | 9/1981 | Valyi | 428/35 |
| 4,365,554 | 12/1982 | Siegal et al. | 101/44 |
| 4,403,547 | 9/1983 | Forberger | 101/170 |
| 4,418,033 | 11/1983 | Hatakeyama | 264/509 |
| 4,419,931 | 12/1983 | Siegal | 101/44 |
| 4,473,008 | 9/1984 | Heyman | 101/170 |
| 4,501,714 | 2/1985 | Strobel et al. | 101/41 |
| 4,530,286 | 7/1985 | Samuels | 101/163 |
| 4,639,341 | 1/1987 | Hanamoto et al. | 264/40.1 |
| 4,760,788 | 8/1988 | Marozzi et al. | 101/333 |
| 4,810,867 | 3/1989 | Speicher | 101/3.1 |
| 4,962,703 | 10/1990 | Bishop | 101/41 |
| 5,023,437 | 6/1991 | Speicher | 101/93.04 |
| 5,123,352 | 6/1992 | Luttrell | 101/375 |
| 5,169,653 | 12/1992 | Tate et al. | 425/503 |
| 5,293,818 | 3/1994 | Mandzuk | 101/41 |
| 5,344,305 | 9/1994 | McKillip | 425/503 |
| 5,456,170 | 10/1995 | Bachmann | 101/35 |

FOREIGN PATENT DOCUMENTS 197709 9/1977 U.S.S.R. .

OTHER PUBLICATIONS

"Pad–Printing Equipment Arms End–Users with New Versatility" published in *Modern Plastics,* Jul. 1997, pp. 83–85.

*Primary Examiner*—Edgar Burr
*Assistant Examiner*—Amanda Sandusky
*Attorney, Agent, or Firm*—Price, Heneveld, Cooper, DeWitt & Litton

[57] ABSTRACT

A method and apparatus are provided for pad printing inked images onto injection-molded pieces, while they are still in the mold, using a robotics device and an ink transfer mechanism.

20 Claims, 7 Drawing Sheets

METHOD AND DEVICE FOR IN-MOLD PAD PRINTING

BACKGROUND OF THE INVENTION

The present invention relates to in-mold pad printing, and more specifically to the pad printing of molded pieces while in the mold of an injection molding machine.

Prior to the present invention, fixing symbols, especially UPC symbols, on injection molded pieces has been accomplished by one of two methods. The first, which can be accomplished either manually or semiautomatically, is to adhere a sticker of the symbol directly onto the molded piece. This method has resulted in many stickers becoming detached from the molded pieces, which is undesirable, due to shaking and vibration during shipping.

The second method by which symbols have been placed on molded pieces is printing an ink image directly onto the molded piece using a printing apparatus that prints on the molded pieces after discharge from the injection molding machine. This method results in significant cost for the purchase, operation, and maintenance of the printing apparatus, as well as time and labor to transport the molded pieces from the injection molding machine to the printing apparatus.

Pad printing has been used for such things as pharmaceutical capsule parts, as in U.S. Pat. No. 3,910,183. In the method disclosed in that patent, cylindrical hard-shell capsule parts are formed on a row of pins of a capsule pin bar. The method uses a dip molding process and the printing does not take place within the normal cycle of the molding process. The capsules are instead transferred, either automatically or manually, to the printing station, thus adding time and expense to the procedure.

A particular type of pad printing has also been used to print UPC symbols, such as that disclosed in U.S. Pat. No. 4,473,008. The process uses an inking plate capable of altering its surface such that different images can be produced during each printing cycle. However, the actual printing or transfer of the inked image onto a specific product does not take place within the normal manufacturing parameters of a molding cycle. Furthermore, the process is limited as to how many products can be printed at a time.

Soviet document SU 290662 discusses a device and process for printing in a mold. The process uses a unit constructed in the form of a drum for applying ink, and which can rotate and move with respect to the mold into which there is fastened a set of printing elements which are sectors of the half-mold. Such a process is adequate for blow molding, but not injection molding. The printing elements used in SU 290662 are parts of the mold and not a separate ink transfer device. Instead of transferring an inked image after the product is hardened, the actual transfer of the inked image is performed as the product is being molded, which does not allow, before printing takes place, any products to be discarded that were not molded to specifications.

Accordingly, it is a desire to have a process where molded parts are printed while they are still in an injection molding machine so that time and cost can be saved while producing a superior printed product.

SUMMARY OF THE INVENTION

One aspect of the present invention is an in-mold pad printing device comprising an injection molding machine; a robotics device having an arm with an end and being in close proximity to the injection molding machine; and a printing plate having at least one printing pad and being attached to the end of the arm, where the robotics device is adapted to move the printing plate to a position where the at least one printing pad picks up an ink image and is adapted to move the printing plate into the injection molding machine to allow the printing pad to transfer the ink image onto the fully molded article.

Another aspect of the present invention is an in-mold pad printing device comprising an injection molding machine having two mold halves; a molded plastic piece formed by the injection molding machine; a robotics device having an arm with an end and attached to the injection molding machine; and a printing plate having at least one printing pad and attached to the end of the arm, where the robotics device is adapted to move the printing plate to a position where the printing pad lifts an ink image from a cliche and is adapted to move the printing plate between the two mold halves and transfer the ink image to the molded plastic piece in one of the mold halves.

Still another aspect of the present invention is a method of printing a molded piece comprising the steps of providing an injection molding machine, fabricating a molded piece in the injection molding machine, providing a robotics device with an end-of-arm tool having at least one printing pad, applying ink to the printing pad, moving the printing pad to position inside the injection molding machine by the robotics device, and transferring the ink to the molded piece by pressing the printing pad against the molded piece.

Yet another aspect of the present invention is a method of pad printing an injection molded plastic piece comprising the steps of fabricating a molded plastic piece by injection molding using two mold halves, providing a robotics device with an arm having an end attached to a plate with a printing pad, moving the plate having the printing pad into position over an etched cliche, pressing the printing pad against the cliche to transfer an ink image to the printing pad, separating the mold halves to create a space therebetween and thereby exposing a portion of the molded plastic piece while retaining the molded plastic piece in position, moving the plate with the printing pad to a position between the mold halves, pressing the printing pad against the molded plastic piece to transfer the ink image onto the molded plastic piece, withdrawing the printing pad, and discharging the molded article.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
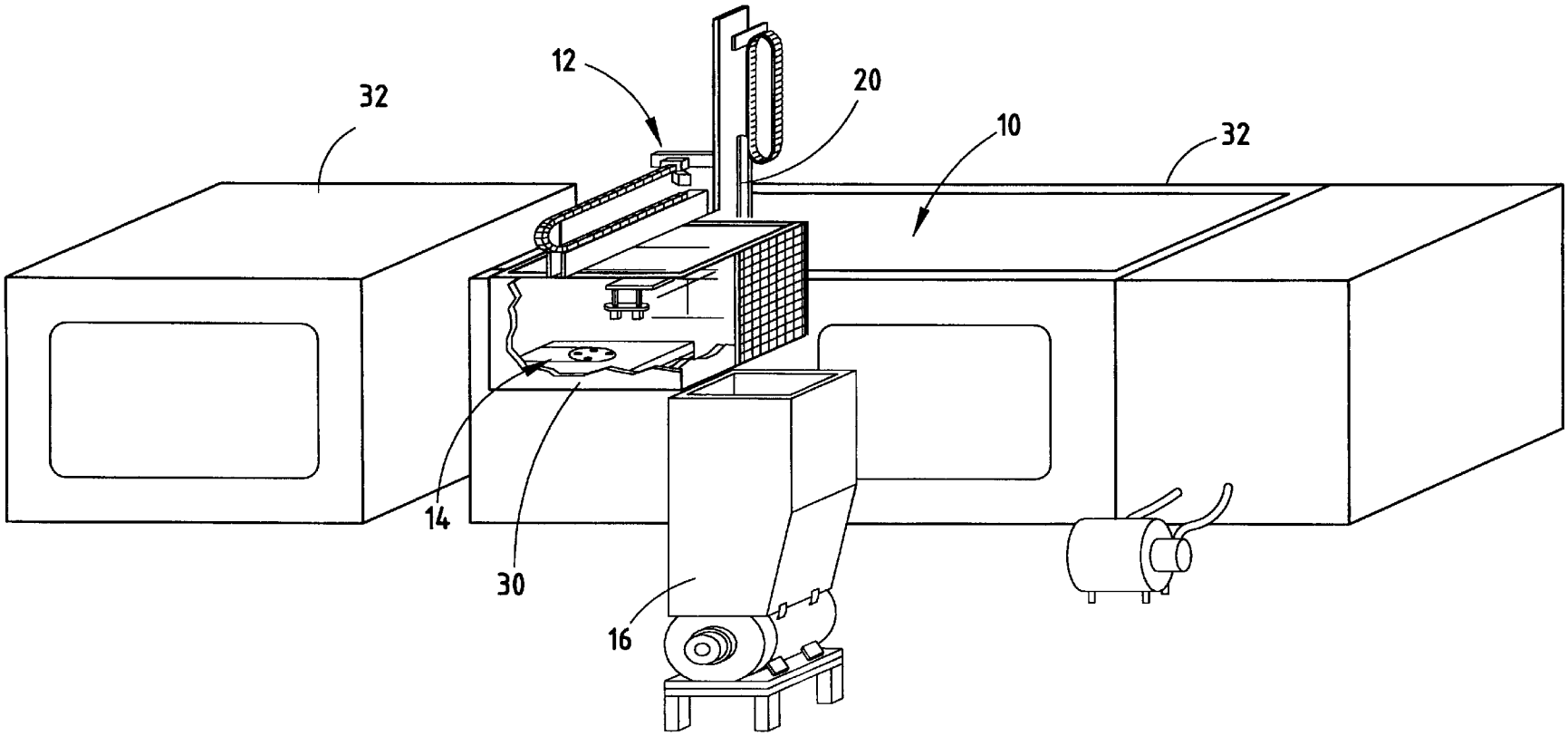
FIG. 1 is perspective view of an injection molding machine, a robotics device including printing pads, and a shuttling device embodying the present invention.

The present invention generally includes an injection molding machine 10, a robotics device 12, and a shuttling device 14 (FIG. 1). The injection molding machine 10 preferably is a standard injection molding machine that can make parts such as drain waste vent (DWV) plastic plumbing fittings made of a substance such as polyvinylchloride (PVC) or acrylonitrile-butadiene-styrene copolymer (ABS). An injection molding device for use with the present invention is provided by Cincinnati Milacron. The system typically also includes a separate grinder 16 which grinds the sprue left over from an injection molding cycle.

Figure 2:
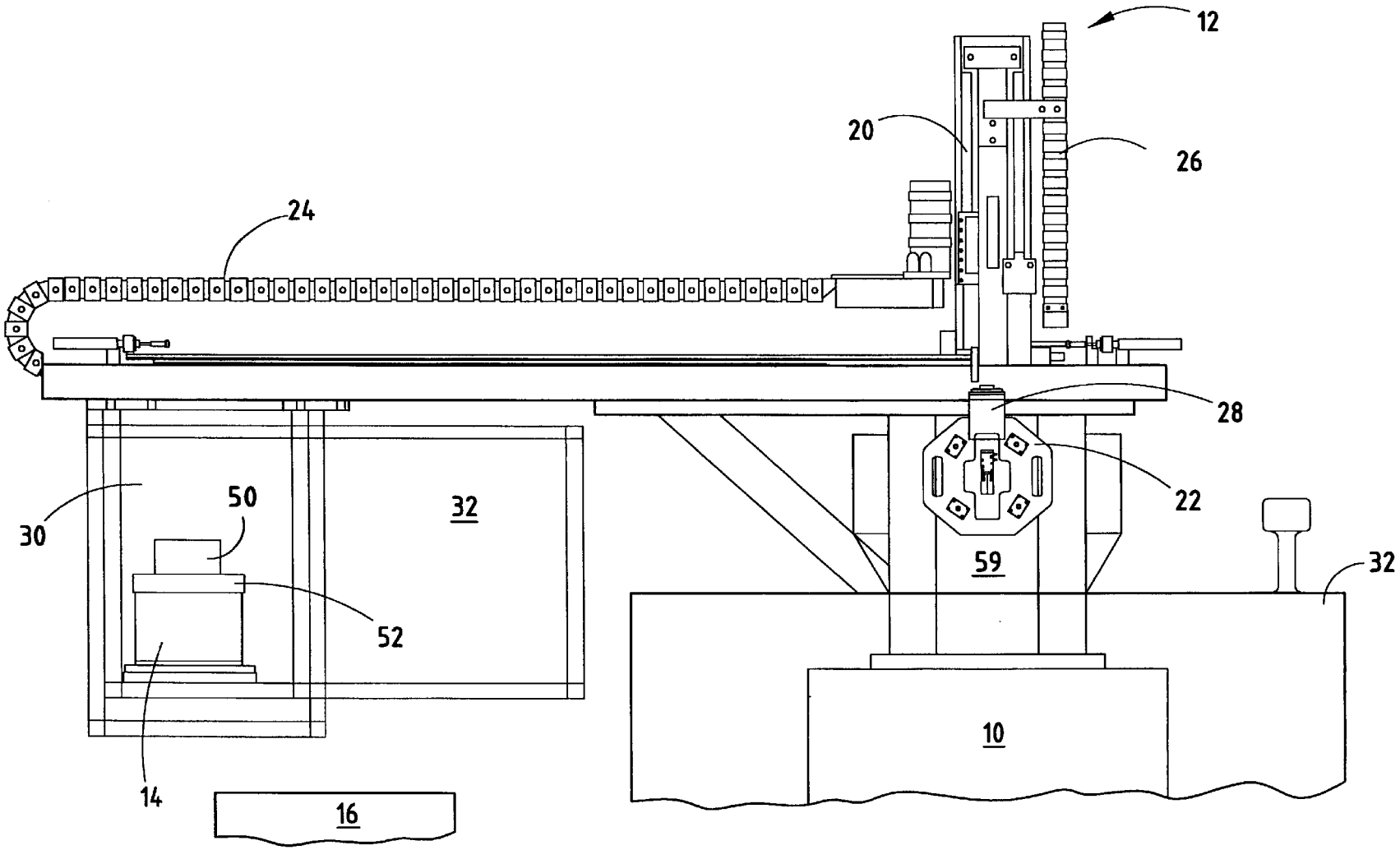
FIG. 2 is a front elevational view of an injection molding machine, a robotics device including printing pads, and a shuttling device embodying the present invention.

FIG. 2 shows the present invention in more detail. The robotics device 12 includes an arm 20, which has attached to it an end-of-arm tool 22. The arm 20 and end-of-arm tool 22 can move side to side due to track 24 and can move up and down due to track 26. A gear track 28 further allows the end-of-arm tool 22 to rotate 90 degrees and thus to be positioned either vertically or horizontally. FIG. 2 also shows cage 30 which houses shuttling device 14, the operation of which is discussed below. Cage 30 is preferably made of a durable transparent material such as Lexan®, but can be made of any material that provides a durable housing for the shuttling device 14. Robotics device 12 is attached to the top of the injection molding machine housing 32, thereby allowing the end-of-arm tool 22 to be moved over injection molding machine 10, in a direction perpendicular to the direction that the mold halves of the injection molding machine open and close. Robotics device 12 allows the end-of-arm tool 22 to be moved into cage 30, and to be positioned at the sprue drop-off location 32.

Figure 3:
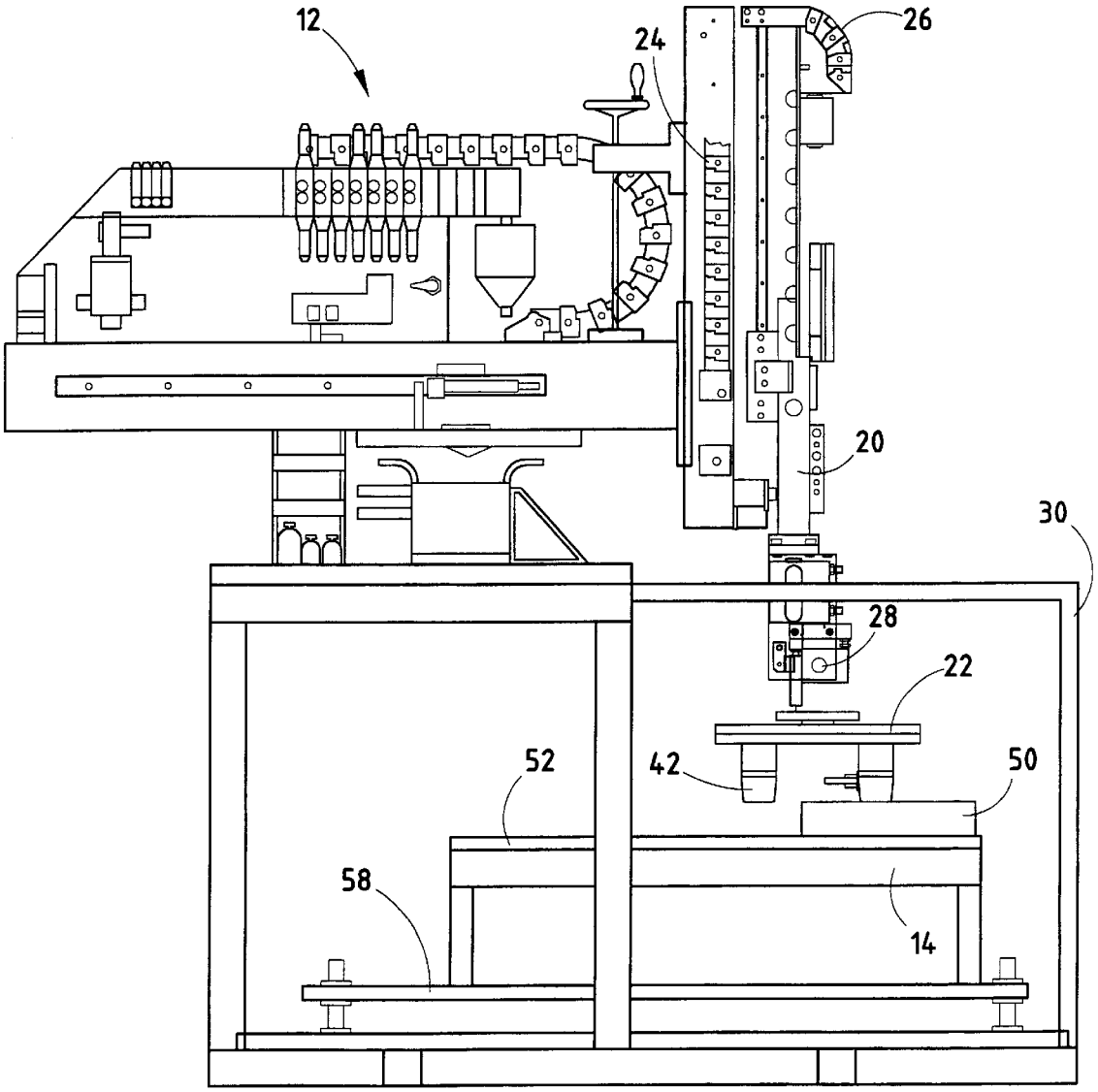
FIG. 3 is a side elevational view of an injection molding machine, a robotics device including printing pads, and a shuttling device embodying the present invention.
Figure 7:
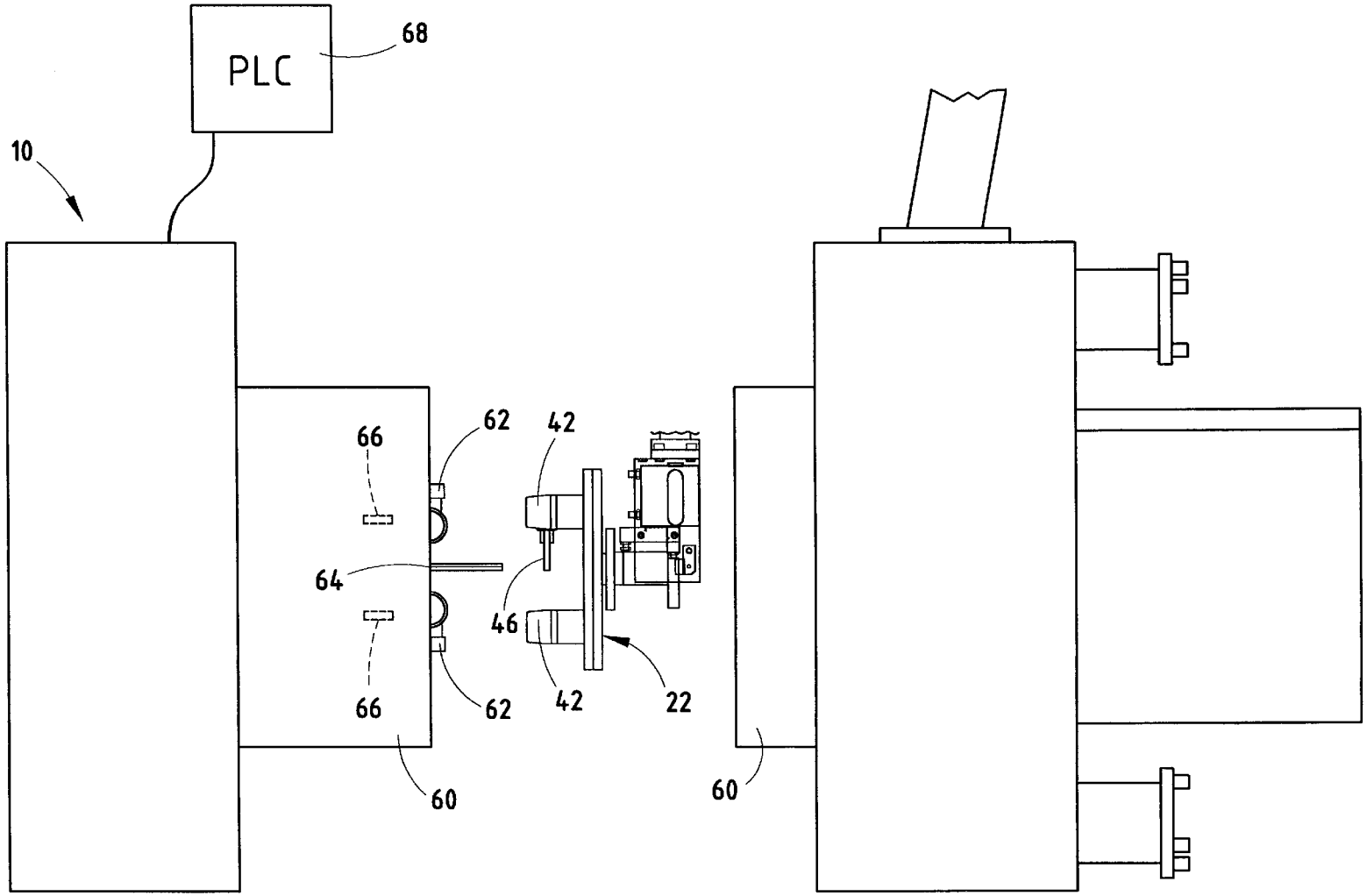
FIG. 7 is a side elevational view of the end-of-arm tool inside an injection molding machine.
Figure 8:
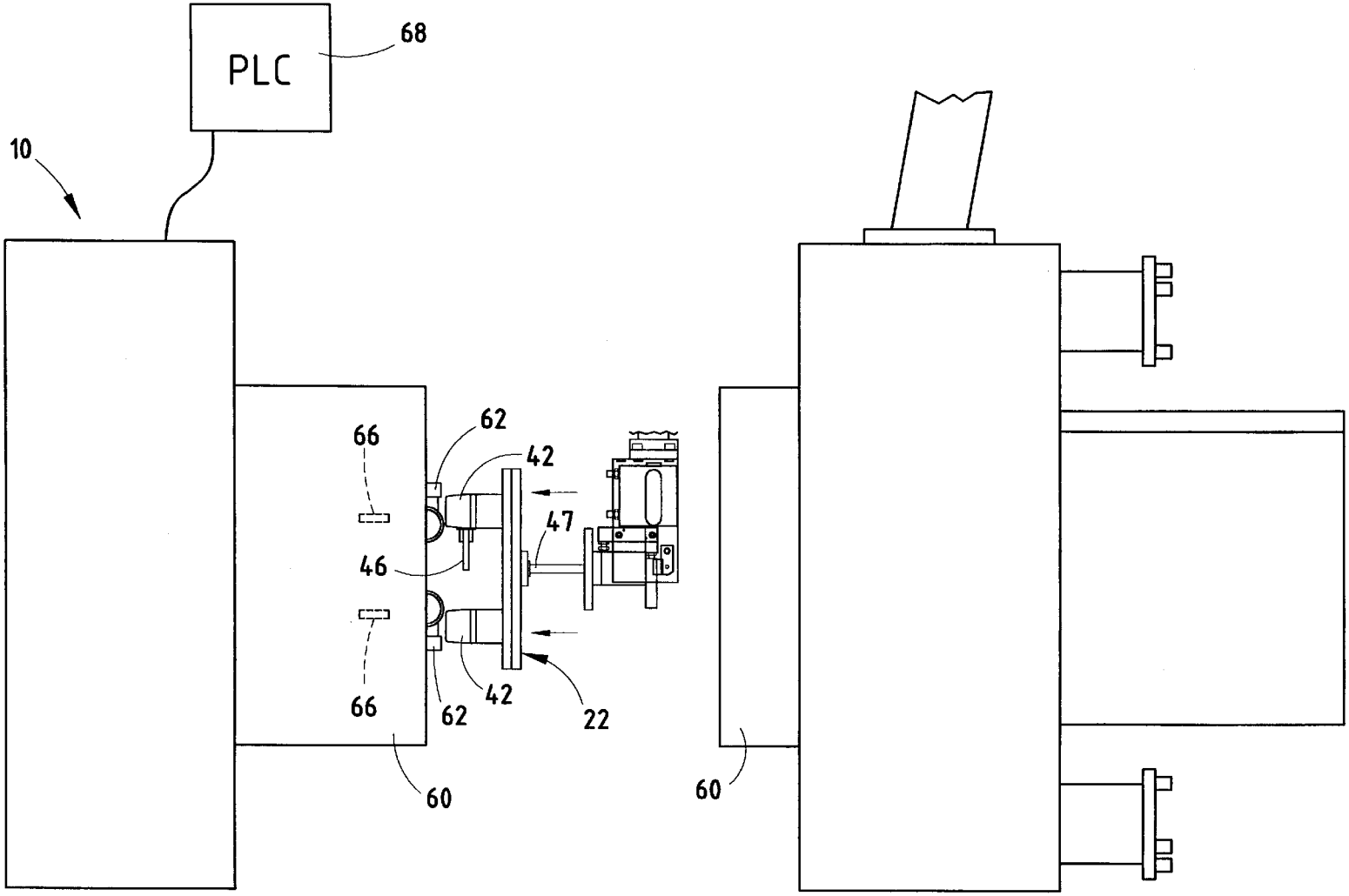
FIG. 8 is a side elevational view of an extended end-of-arm tool inside an injection molding machine.

FIG. 3 shows in more detail a robotics device 12 of the present invention and end-of-arm tool 22 inside cage 30. A programmable logic controller (PLC) 68 (FIGS. 7–8) controls the actions of the robotics device 12 and injection molding machine 10. A robotics device that is useful for the present invention is that provided by Geiger Handling.

Figure 4:
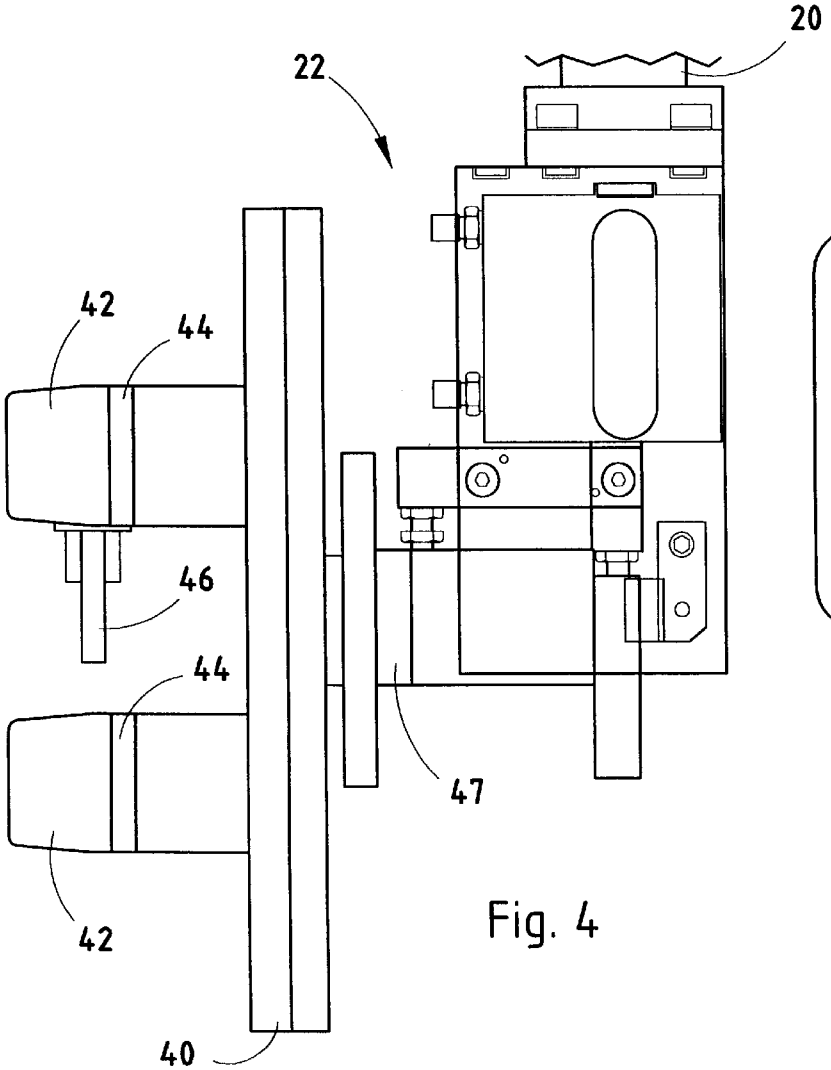
FIG. 4 is a side elevational view of the end-of-arm tool of the present invention.

As shown in FIG. 4, the end-of-arm tool 22, shown in the vertical position, includes a pad plate 40, pads 42, pad holders 44, and a sprue gripper 45. End-of-arm tool 22 is attached to arm 20 by a high-power magnet (not shown). Pads 42 are preferably made of silicone, but may be made of other substances that transfer ink effectively. Sprue gripper 45 is located centrally on the end-of-arm tool 22 so that it may grab the sprue which remains at the center of the mold after a molding cycle is completed. Sprue gripper 45 has two fingers 46' and 46" which move laterally in opposite directions, thus creating an opening between them that is slightly larger than the sprue left in the injection molding machine 10 after a cycle of injection molding. This allows the fingers 46' and 46" to open and be moved around the sprue to allow sprue gripper 45 to close its fingers 46' and 46" and grip the sprue for removal from the injection molding machine 10. Two pneumatic cylinders 47, one on each side of the end-of-arm tool 22, when activated force end-of-arm tool 22 forward to allow the printing pads to contact the molded part. The end-of-arm tool is made by a typical manufacturer such as Geiger Handling.

Figure 5:
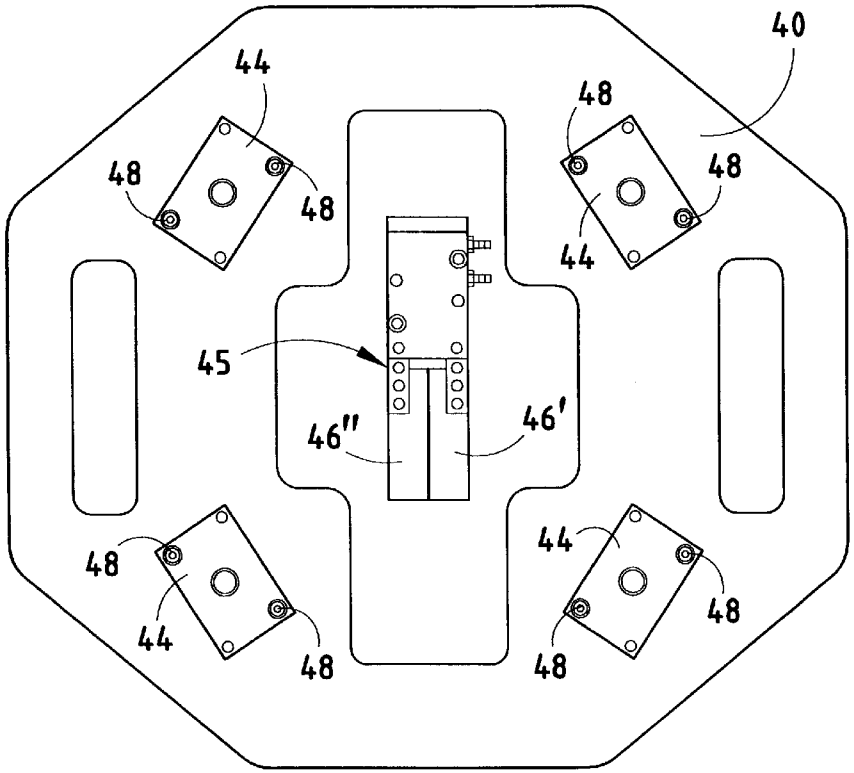
FIG. 5 is a front elevational view of the end-of-arm tool.

FIG. 5 shows the end-of-arm tool including pad plate 40 and pad holders 44, which include holes 48 to allow removal and replacement of the pads 42 by bolting the pads 42 to the pad holders 44 which are permanently affixed to pad plate 40. The pads 42 may also be attached by magnets if desired. In FIG. 5, pad plate 40 includes four holders 44 for pads 42, but may include more or fewer pad holders depending on the number of products produced by the injection molding machine during each cycle.

Figure 6:
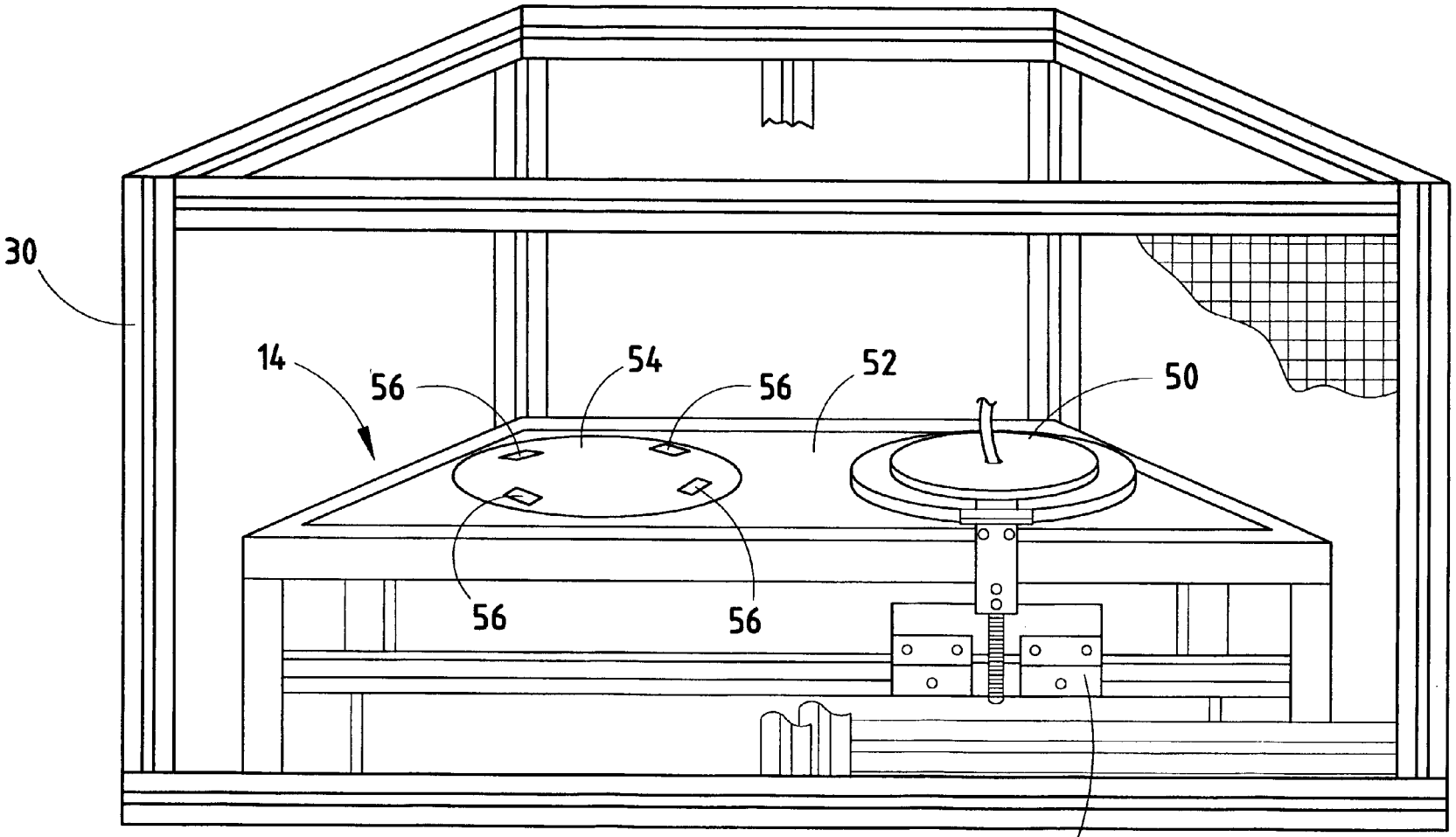
FIG. 6 is an elevational view of the shuttling device of the present invention.

FIG. 6 shows in detail the shuttling device of the present invention. Shuttling device 14 has an ink transfer mechanism which includes an ink cup 50, a plate 52, and a cliche 54 with etchings 56. The cliche 54 is a quarter-inch thick steel plate with a 210 mm diameter. Etchings 56 are about 16 microns deep and retain ink so that pads 42 may lift the ink from the cliche 54. Shuttling device 14 also includes a guide 58 which allows motion of the ink cup along plate 52 and cliche 54. Ink cup 50, cliche 54 and the plate and guide of the shuttling device 14, as well as the ink used for the present invention, are standard components made in the industry, such as those provided by Tampo Print International.

A thinner and a retarder are added to the ink to retain the consistency of the ink. A proper three-way ratio of ink to thinner to retarder ensures a usable consistency and ensures that the ink mixture will not dry before it is applied to the part, but will dry quickly after application. The following table shows the preferable amounts of ink, thinner, and retarder for both a white ink and a black ink.

| | White | Black |
|---|---|---|
| Type U High Density Ink (White or Black) | 400 g | 400 g |
| Type VD Thinner | 48 g | 80 g |
| Type VZ Retarder | 20 g | 60 g |

Typically, the ink transfers effectively onto the parts, and due in part to the heat of the molded part, the ink dries quickly enough that the parts can be ejected into a pool of cool water to allow quick curing of the plastic.

Operation

The printing cycle of the present invention starts with the end-of-arm tool 22 in the home position 59, which is directly over the mold, as shown in FIG. 2. The end-of-arm tool 22 is positioned vertically at this stage. The mold halves 60 are open (see FIG. 7). The injection molding machine 10 begins its cycle and triggers the mold halves 60 to close. The PLC 68 directs the robotics device 12 to begin its program when the mold halves 60 close. The injection molding machine 10 then injects the molding substance, such as PVC or ABS, into the mold. Once the robotic device 12 is triggered, end-of-arm tool 22 is rotated to a horizontal position and is moved to the sprue drop-off location 32, where the sprue gripper mechanism 46 opens and closes.

Ink cup 50, which is located on the shuttling device 14, moves to the back of plate 52, exposing etchings 56 on cliche 54. As ink cup 50 moves to the back of plate 52, ink cup 50 deposits ink into each of etchings 56, but not onto the surface of the cliche 54 due to a sharp edge (not shown) which scrapes away any ink deposited on the surface of cliche 54.

The robotics device 12 then moves the end-of-arm tool 22, which is still in a horizontal position, over the cliche 54. The robotics device 12 lowers the end-of-arm tool 22 into cage 30 and onto cliche 54 so that the pads 42 pick up an inked image off of the cliche 54 from the ink in the etchings 56. The robotics device 12 then moves the end-of-arm tool 22 up and out of cage 30 and back to the home location 59, while the end-of-arm tool 22 is simultaneously rotated to a vertical position. The mold halves 60 then open, partially exposing the molded parts 62. The cavities in the mold halves 60 hold the molded parts in place by friction due to the snug fit of the molded parts in the cavities.

The robotics device 12 lowers the end-of-arm tool 22 into the mold opening location 64. The end-of-arm tool 22 remains in a vertical position throughout this stage of the process. The robotics device 12 then extends the end-of-arm tool horizontally by the PLC 68 triggering the two pneumatic cylinders 47 which force the end-of-arm tool 22 forward so that the pads 42 make contact with the molded parts 62 (FIG. 7), which are still retained in one half of the mold. Inked images are transferred via adhesion from the pads 42 to the molded parts 62. As the pads 42 transfer the inked images, the sprue gripper mechanism 45 opens, moves into position, and closes on the sprue 64 remaining in the mold. The sprue gripper mechanism 45 retains the sprue 64 and removes it from the mold as the end-of-arm tool 22 is retracted by the pneumatic cylinders 47 and raised out of the injection molding machine 10 by robotics device 12. The molded parts 62 are ejected from the mold by ejector pins 66, which are a part of the injection molding machine 10 and are positioned behind the mold cavities. The ejector pins 66 are set on a time-delay by the PLC 68 to allow time for the printing to take place. The robotics device 12 raises the end-of-arm tool 22 out of the molding machine 10 and back to the home position 59. The mold halves 60 close and the cycle is repeated for as many cycles as desired.

The above-described apparatus and process result in a very accurate and efficient method by which to transfer images, such as UPC symbols, onto injection molded parts. Furthermore, the ink used with the present invention is quick drying and durable.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. An in-mold pad printing device comprising:

an injection molding machine having a mold cavity;

a robotics device having an arm with an end, the robotics device being in close proximity to the injection molding machine;

a printing plate having at least one printing pad, the printing plate attached to the end of the arm; and said robotics device positioned and adapted to move said printing plate to a position where said at least one printing pad picks up an ink image, and adapted to move said printing plate to said mold cavity in said injection molding machine to allow said printing pad to transfer the ink image to a molded object in said mold cavity.

2. The device defined in claim 1 and further comprising a cliche having etchings, being operably engaged with said robotics device and adapted to transfer an ink image onto said at least one printing pad.

3. The device defined in claim 2 and further comprising a shuttling device having an ink cup to deposit ink into said etchings in the cliche.

4. The device defined in claim 3 wherein the etchings have a depth of about 16 microns.

5. The device defined in claim 4 and further comprising a sprue gripper.

6. The device defined in claim 1 and further comprising a sprue gripper.

7. An in-mold pad printing device comprising:

an injection molding machine having two mold halves defining a mold cavity for injection molding a molded plastic piece;

a robotics device having an arm with an end, the robotics device attached to the injection molding machine;

a cliche having etchings and being operably engaged with said robotics device;

a printing plate having at least one printing pad, the printing plate attached to the end of the arm; and said robotics device adapted to move said printing plate to a position where said printing pad lifts an ink image from the etchings in said cliche, said robotics device further adapted to move said printing plate between said two mold halves and to transfer the ink image to the molded plastic piece retained in said mold cavity of one of said mold halves.

8. The device defined in claim 7 and further comprising ejection pins controlled by a PLC which causes said ejection pins to eject the molded piece from said mold cavity.

9. The device defined in claim 8 and further comprising a shuttling device having an ink cup to deposit ink into said etchings in said cliche.

10. The device defined in claim 9 wherein the etchings have a depth of about 16 microns.

11. The device defined in claim 7 and further comprising a sprue gripper.

12. A method of printing a molded piece comprising the steps of:

(a) providing an injection molding machine having a mold cavity;

(b) fabricating a molded piece in said mold cavity of said injection molding machine;

(c) providing a robotics device with an end-of-arm tool having at least one printing pad;

(d) applying ink to said at least one printing pad;

(e) opening said injection molding machine to expose a portion of the molded piece;

(f) moving said printing pad to a position at said mold cavity inside said injection molding machine by using said robotics device; and (g) transferring the ink to the molded piece by pressing said printing pad against the molded piece in said mold cavity.

13. The method as defined in claim 12 wherein the step of applying ink to the printing pad includes pressing the printing pad against a cliche.

14. The method as defined in claim 13 wherein the step of moving the printing pad to a position inside the injection molding machine includes rotating the end-of-arm tool between a horizontal position and a vertical position.

15. The method as defined in claim 14 and further including the step of separating and pulling a sprue out of said injection molding machine by a gripper mechanism attached to the end-of-arm tool after or simultaneous with the step of transferring ink to the molded piece.

16. The method as defined in claim 12 wherein the step of moving the printing pad to a position inside the injection molding machine includes rotating the end-of-arm tool between a horizontal position and a vertical position.

17. The method as defined in claim 12 and further including the step of pulling a sprue out of the molding device by a gripper mechanism attached to the end-of-arm tool after or simultaneously with the step of transferring ink to the molded piece.

18. A method of pad printing an injection molded plastic piece comprising the steps of:

(a) fabricating a molded plastic piece by injection molding using two mold halves;

(b) providing a robotics device with an arm having an end, the end having a plate with a printing pad;

(c) moving the plate having the printing pad to a position over an etched cliche;

(d) pressing the printing pad against the cliche to transfer an ink image to the printing pad;

(e) separating the mold halves sufficiently to create a space therebetween and thereby exposing a portion of the molded plastic piece while retained in one mold half;

(f) moving the plate with the printing pad to a position between the mold halves; and (g) pressing the printing pad against the molded plastic piece to transfer the ink image onto the molded plastic piece.

19. The method as defined in claim 18 and further comprising the step of pulling the sprue out of the mold after or simultaneously with the step of pressing the printing pad against the molded plastic piece.

20. The method as defined in claim 19 wherein the step of moving the printing pad to a position inside the injection molding machine includes rotating the end-of-arm tool between a horizontal position and a vertical position.

* * * * *